US011992086B2

(12) United States Patent
Callahan et al.

(10) Patent No.: US 11,992,086 B2
(45) Date of Patent: May 28, 2024

(54) ARTICULATING FOOTWEAR STROBEL WITH BLADDER AND TENSILE COMPONENT

(71) Applicant: NIKE, Inc., Beaverton, OR (US)

(72) Inventors: Ryan P. Callahan, Portland, OR (US); Jeremy L. Connell, Hillsboro, OR (US); Carrie L. Davis, Portland, OR (US); Windra Fahmi, Beaverton, OR (US); Gjermund Haugbro, Beaverton, OR (US); Fiona L. Lesecq, Portland, OR (US); Jason R. Meeker, Hillsboro, OR (US); Benjamin Stewart, Beaverton, OR (US); Dylan S. Van Atta, Portland, OR (US); Darlan Zacharia, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 126 days.

(21) Appl. No.: 17/690,819

(22) Filed: Mar. 9, 2022

(65) Prior Publication Data

US 2022/0322786 A1 Oct. 13, 2022

Related U.S. Application Data

(60) Provisional application No. 63/173,808, filed on Apr. 12, 2021.

(51) Int. Cl.

| | |
|---|---|
| ***A43B 13/20*** | (2006.01) |
| ***A43B 13/12*** | (2006.01) |
| ***A43B 13/40*** | (2006.01) |

(52) U.S. Cl.

CPC ..... *A43B 13/20* (2013.01); *A43B 13/127* (2013.01); *A43B 13/40* (2013.01)

(58) Field of Classification Search

CPC ..... A43B 13/20; A43B 13/127; A43B 13/40; A43B 13/189; A43B 13/38; A43B 13/386;

(Continued)

(56) References Cited

U.S. PATENT DOCUMENTS

| | | | |
|---|---|---|---|
| 4,183,156 | A | 1/1980 | Rudy |
| 4,219,945 | A | 9/1980 | Rudy |

(Continued)

FOREIGN PATENT DOCUMENTS

| | | | |
|---|---|---|---|
| CN | 111989007 | A | 11/2020 |
| TW | 201808140 | A | 3/2018 |

(Continued)

*Primary Examiner* — Sharon M Prange
*Assistant Examiner* — Haley A Smith
(74) *Attorney, Agent, or Firm* — Quinn IP Law

(57) ABSTRACT

A strobel for an article of footwear includes a polymeric bladder defining an interior cavity and configured to retain a fluid in the interior cavity. The polymeric bladder has a peripheral flange extending around at least a portion of a perimeter of the interior cavity. A first bond secures opposing inner surfaces of the polymeric bladder to one another and extends transversely inward from a medial side of the peripheral flange only partway transversely across the interior cavity. A second bond is rearward of the first bond. The second bond extends transversely inward from a lateral side of the peripheral flange only partway transversely across the interior cavity. A tensile component is disposed in the interior cavity. An outer edge of the tensile component extends transversely inward at and borders a perimeter of the first bond and a perimeter of the second bond.

20 Claims, 8 Drawing Sheets

(58) Field of Classification Search
CPC ..... A43B 17/006; A43B 17/026; A43B 17/03; A43B 7/143; A43B 7/1445; A43B 7/154; A43B 7/1425; A43B 9/02
USPC ..... D2/961
See application file for complete search history.

(56) References Cited

U.S. PATENT DOCUMENTS

| | | | | |
|---|---|---|---|---|
| 4,936,029 | A | 6/1990 | Rudy | |
| 5,042,176 | A | 8/1991 | Rudy | |
| 5,595,004 | A * | 1/1997 | Lyden | A43B 13/206 36/35 B |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 8,281,504 | B2 * | 10/2012 | Morita | A43B 17/026 36/43 |
| 8,839,530 | B2 | 9/2014 | Smith et al. | |
| 9,894,959 | B2 * | 2/2018 | Taylor | A43B 13/203 |
| 10,477,919 | B2 * | 11/2019 | Taylor | A43B 13/203 |
| 10,485,298 | B2 | 11/2019 | Greene | |
| 11,039,662 | B2 * | 6/2021 | Taylor | A43B 13/20 |
| 11,219,271 | B2 * | 1/2022 | Auyang | A43B 9/02 |
| 11,253,026 | B2 * | 2/2022 | Auyang | B29D 35/142 |
| 2009/0126226 | A1 * | 5/2009 | Morita | A43B 17/026 36/43 |
| 2012/0233878 | A1 * | 9/2012 | Hazenberg | A43B 13/189 36/29 |
| 2016/0192737 | A1 | 7/2016 | Campos, II et al. | |
| 2017/0042286 | A1 * | 2/2017 | Meschter | A43B 13/04 |
| 2018/0125162 | A1 * | 5/2018 | Taylor | A43B 13/203 |
| 2018/0332924 | A1 | 11/2018 | Bailey et al. | |
| 2018/0332925 | A1 | 11/2018 | Bailey et al. | |
| 2019/0261739 | A1 * | 8/2019 | Taylor | A43B 13/206 |
| 2019/0365036 | A1 | 12/2019 | Meeker | |
| 2019/0365038 | A1 * | 12/2019 | Auyang | A43B 13/186 |
| 2019/0365039 | A1 | 12/2019 | Auyang et al. | |
| 2019/0365040 | A1 * | 12/2019 | Auyang | B29D 35/142 |
| 2019/0380436 | A1 | 12/2019 | Dojan et al. | |
| 2021/0298419 | A1 | 9/2021 | Aslani et al. | |
| 2022/0087363 | A1 * | 3/2022 | Auyang | A43B 9/02 |
| 2022/0132985 | A1 * | 5/2022 | Auyang | A43D 11/006 36/29 |

FOREIGN PATENT DOCUMENTS

| | | | |
|---|---|---|---|
| TW | M595979 | U | 6/2020 |
| TW | 202023428 | A | 7/2020 |
| TW | 202027639 | A | 8/2020 |

* cited by examiner

ARTICULATING FOOTWEAR STROBEL WITH BLADDER AND TENSILE COMPONENT

CROSS-REFERENCE TO RELATED APPLICATION

This application claims the benefit of priority to U.S. Provisional Application No. 63/173,808, filed Apr. 12, 2021 which is incorporated by reference in its entirety.

TECHNICAL FIELD

The present disclosure generally relates to a strobel for an article of footwear, and, more particularly, a strobel configured as a fluid-filled bladder.

BACKGROUND

Articles of footwear generally include two primary elements: an upper and a sole structure. The sole structure is configured to be located under a wearer's foot to space the foot away from the ground. Mobility, flexibility, support, and cushioning are sometimes competing objectives in designing a sole structure.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
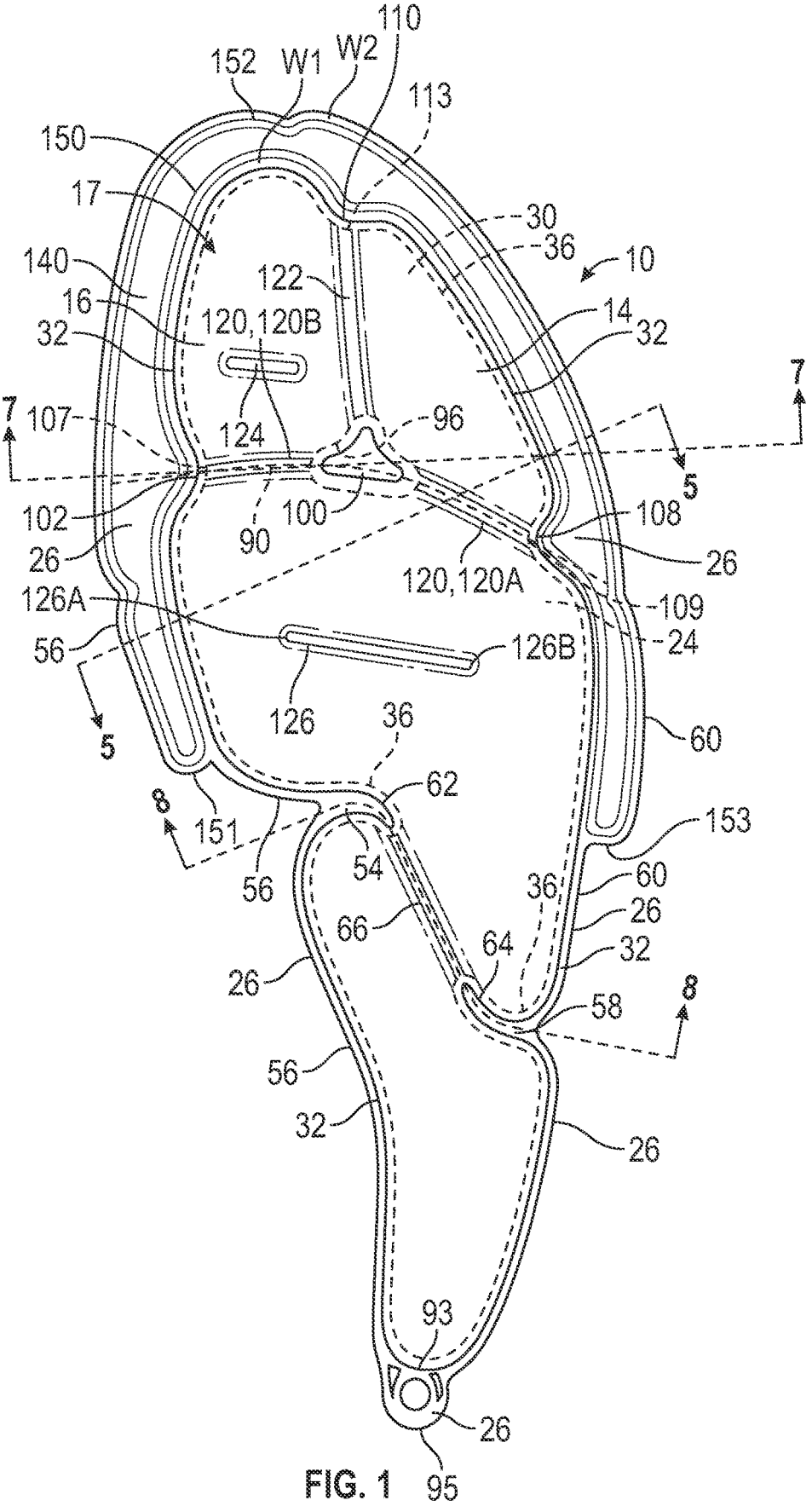
FIG. 1 is a plan view of a top side of a strobel for an article of footwear.

The present disclosure generally relates to a strobel for an article of footwear that is configured as an articulating, fluid-filled polymeric bladder. In comparison to a traditional strobel material, the bladder strobel of the present disclosure offers greater cushioning, flexibility, and energy return. Additionally, the bladder strobel may be the foot-receiving surface of the sole structure. Stated differently, no cover or other additional layer need be present between the foot and the bladder strobel. This enables a relatively low overall height of the sole structure, which may be beneficial for some activities. For example, activities that involve extensive lateral movement and/or for which greater tactile feedback is advantageous may benefit from the use of the polymeric bladder strobel disclosed herein.

In an example, a strobel for an article of footwear includes a polymeric bladder defining an interior cavity and configured to retain a fluid in the interior cavity. The polymeric bladder has a peripheral flange extending around at least a portion of a perimeter of the interior cavity. A first bond secures opposing inner surfaces of the polymeric bladder to one another and extends transversely inward from a medial side of the peripheral flange only partway transversely across the interior cavity. A second bond is rearward of the first bond, and secures the opposing inner surfaces of the polymeric bladder to one another. The second bond extends transversely inward from a lateral side of the peripheral flange only partway transversely across the interior cavity. A tensile component is disposed in the interior cavity and is secured to the opposing inner surfaces of the polymeric bladder. An outer edge of the tensile component extends transversely inward at and borders a perimeter of the first bond and a perimeter of the second bond.

By securing the opposing inner surfaces to one another, the tensile component limits the separation between the opposing inner surfaces due to inflation of the bladder. Stated differently, the tensile component limits the height of the inflated bladder. Because the tensile component borders and does not extend between the inner surfaces at the first bond and the second bond, the bladder is a lesser height at the first bond and the second bond, creating greater flexibility of the bladder at the first and second bonds than at the tensile component. Accordingly, articulation of the bladder tends to occur at the first bond and the second bond under longitudinal or lateral flexing of the foot supported on the bladder. Additionally, because the first bond and the second bond extend from opposite sides of the peripheral flange (the medial side and the lateral side, respectively), with the second bond rearward of the first bond, flexing may tend to occur not only at either or both of the two bonds, but along a line between the two bonds, which will be at an angle to a longitudinal midline of the bladder and extending forward and toward the medial side.

In one or more implementations, the first bond and the second bond may be nonlinear. For example, the first bond may curve rearward from the medial side of the peripheral flange. The second bond may curve forward from the lateral side of the peripheral flange. By each curving in a direction toward the other, flexing along a line that connects the two bonds is encouraged.

The length, width, and overall height of the polymeric bladder may also be optimized for the purposes of the footwear in which it is implemented. For example, the polymeric bladder may extend in a forefoot region and a midfoot region of the strobel and may taper in width in the midfoot region to a rear extent of the fluid-filled cavity. The rear extent may be disposed no further back than a forward half of the heel region. By limiting the components of the strobel largely to the forefoot and midfoot regions and only a forward half of the heel region (if the bladder extends at all into the heel region), the bladder is easier to flex in the longitudinal direction, such as with dorsiflexion of the foot. Because the bladder tapers in width as it extends rearward (e.g., the midfoot region is narrower than the forefoot region) the cushioning and energy return properties of the bladder are focused in the forefoot region and overall bulk of the strobel is minimized.

Moreover, a maximum height of the strobel may be less than or equal to 5 millimeters. In another example, the maximum height may be less than or equal to 5.5 millimeters, or may be between about 4.5 and 5.5 millimeters. The maximum height may be from the foot-facing surface to the ground-facing surface of the strobel. This relatively low height may provide sufficient cushioning and energy return than a greater height without compromising the tactile feedback of the bladder underfoot.

In one or more examples, the tensile component may have an aperture in a forefoot region of the strobel. The aperture may be disposed between a hallux portion and a second toe portion of the forefoot region. The opposing inner surfaces of the bladder may be bonded to one another at the aperture. Accordingly, the fluid-filled interior cavity and the tensile component may surround the bond at the aperture. There is less resistance to flexing of the bladder at the aperture than at the fluid-filled interior, which, due to inflation pressure and the presence of the tensile component, provides greater resistance to flexing and bending than does the bond at the aperture. For example, the aperture may fall near a metatarsophalangeal joint line between the hallux portion and the second toe portion. In this location, the aperture may be disposed between the big toe and the little toe of a wearer at or near the metatarsophalangeal joint line of the wearer.

In addition to the first and second bonds and a bond at the aperture in the tensile component, the peripheral flange may have inward protrusions at notches in the tensile component to promote flexibility of the bladder at those locations. For example, the peripheral flange may have a medial protrusion protruding transversely inward at the medial side of the peripheral flange to define a boundary between a toe section of a forefoot region of the strobel and a metatarsal section of the forefoot region of the strobel. The outer edge of the tensile component may extend transversely inward at and border the medial protrusion of the peripheral flange.

Similarly, the peripheral flange may have a lateral protrusion protruding transversely inward at the lateral side of the peripheral flange to define a boundary between the toe section of the forefoot region of the strobel and the metatarsal section of the forefoot region of the strobel. The outer edge of the tensile component may extend transversely inward at and border the lateral protrusion of the peripheral flange.

The peripheral flange is simply the polymeric material of the bladder. In other words, there is no fluid-filled interior cavity at the peripheral flange. The peripheral flange, being of lesser thickness (e.g., lower height) than the inflated part of the bladder is more easily flexed. Because a foot naturally flexes at the metatarsophalangeal joint, providing the inward protrusions and notches in the tensile component at these locations enhances flexibility while still providing cushioning and flexibility under the toes and the metatarsal heads.

The specific construction of the polymeric bladder may include a first polymeric sheet and a second polymeric sheet secured to one another at and forming the peripheral flange, the first bond, and the second bond. The opposing inner surfaces of the bladder may include a first inner surface of the first polymeric sheet and a second inner surface of the second polymeric sheet. The tensile component may include a first tensile layer secured to the first inner surface, a second tensile layer secured to the second inner surface, and a plurality of tethers spanning the interior cavity from the first tensile layer to the second tensile layer and connecting the first tensile layer to the second tensile layer.

In addition to the bonds of the first sheet to the second sheet at the first bond, the second bond, and at the aperture (if present), the bladder may also have one or more inwardly-protruding partial welds, referred to as partial bonds, at which the thickness of the bladder is reduced, increasing flexibility and promoting flexing of the bladder at the partial weld. For example, the first polymeric sheet may be joined to the first tensile layer at a first partial bond that protrudes inward from the first polymeric sheet toward the second polymeric sheet only partially across the plurality of tethers. Because it extends only partially across the tethers toward the second sheet, the fluid-filled interior cavity is present between the polymeric sheets at the first partial bond. The first partial bond thus creates a narrowing of but not a closure of the interior cavity. Because a bladder of lower height is easier to flex than a bladder with a greater height, the inflated bladder is easier to flex at the narrowed cavity under the first partial bond (e.g., at the reduced height of the bladder at the first partial bond). The first partial bond may extend across the first polymeric sheet from the first bond to the second bond, thereby creating the location at which bending (e.g., flexing) of the bladder will most easily occur.

Similarly, the first polymeric sheet may be joined to the first tensile layer at a transverse partial bond that protrudes inward from the first polymeric sheet toward the second polymeric sheet only partially across the plurality of tethers. The transverse partial bond may extend from the lateral protrusion to the medial protrusion. As such, the transverse partial bond may extend under and track the metatarsophalangeal joints of an overlying foot. If the aperture and central bond are present, the transverse partial bond may extend to the central bond. For example, a lateral portion of the transverse partial bond may extend from the lateral protrusion to the central bond, and a medial portion of the transverse partial bond may extend from the medial protrusion to the central bond.

In one or more examples, the peripheral flange may have a front protrusion protruding rearward from a front of the peripheral flange. The outer edge of the tensile component may extend rearward at and border the front protrusion of the peripheral flange. The first polymeric sheet may be joined to the first tensile layer at a front partial bond that protrudes inward from the first polymeric sheet toward the second polymeric sheet only partially across the plurality of tethers. The front partial bond may extend from the front protrusion rearward toward the transverse partial bond. In examples in which the aperture and central bond are present, the transverse partial bond may extend to the central bond. Accordingly, both the transverse partial bond and the front partial bond may extend from the respective inward protrusions of the peripheral flange to the central bond.

Additional partial bonds that protrude inward from the first polymeric sheet toward the second polymeric sheet only partially across the plurality of tethers may include a toe joint partial bond and/or a middle partial bond. The toe joint partial bond may extend forward of the transverse partial bond and may be non-intersecting with the transverse partial bond and non-intersecting with the front partial bond. For example, the toe joint partial bond may be configured to align with and underlie an overlying joint of a hallux forward of a metatarsophalangeal joint of an overlying foot.

The middle partial bond may extend rearward of the transverse partial bond and forward of the first partial bond, may be non-intersecting with the transverse partial bond and the first partial bond, and may be disposed between the medial side of the peripheral flange and the lateral side of the peripheral flange without extending completely to either side of the peripheral flange. Accordingly, the interior cavity may completely surround the middle partial bond such that the middle partial bond does not fluidly isolate a portion of the interior cavity forward of the middle partial bond from a portion of the interior cavity rearward of the middle partial bond.

Other aspects of the bladder may enable its easy integration within an article of footwear. For example, the peripheral flange may be wider forward of the first bond than rearward of the first bond at both the medial side and the lateral side. The wider peripheral flange in this area may enable it to be easily stitched to a footwear upper. Additionally, the peripheral flange may define a groove extending lengthwise along the peripheral flange from the medial side to the lateral side and forward of the first bond. The groove serves as a visible path for a needle to follow when stitching the upper to the peripheral flange of the bladder.

The above features and advantages and other features and advantages of the present teachings are readily apparent from the following detailed description of the modes for carrying out the present teachings when taken in connection with the accompanying drawings. It should be understood that, even though in the following drawings, embodiments may be separately described, single features thereof may be combined to additional embodiments.

Figure 4:
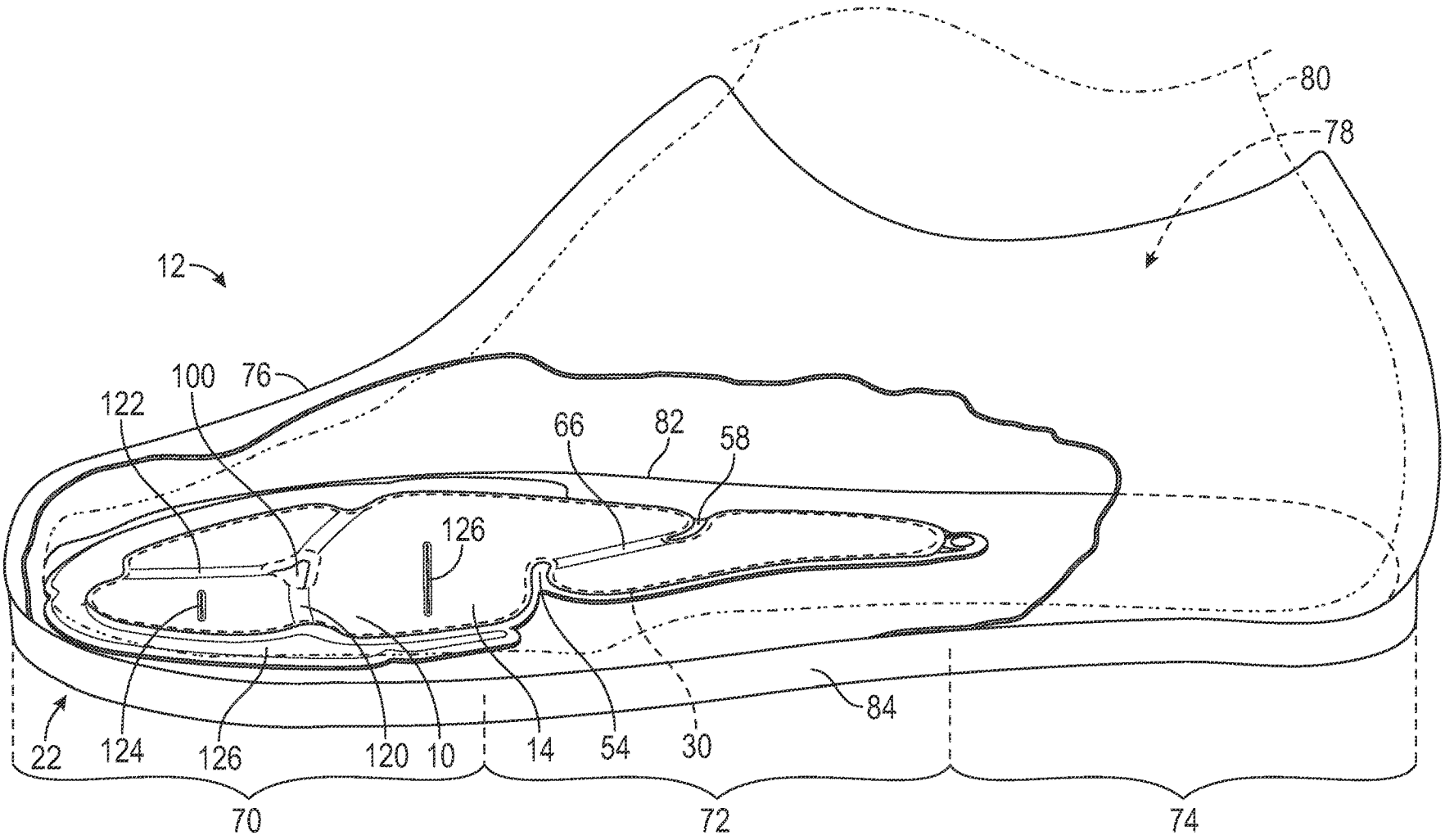
FIG. 4 is a side perspective view of an article of footwear having an upper shown in partial cutaway and showing the strobel of FIG. 1 disposed in a foot-receiving cavity with a foot shown in phantom resting directly on the strobel.

With reference to the drawings, in which like reference numbers refer to like components throughout the views, FIG. 1 is a plan view of a strobel 10 for an article of footwear 12 (shown in FIG. 4). The strobel 10 is configured as an articulating, fluid-filled polymeric bladder 14. In FIG. 1, a top side (e.g., a first side) of the strobel 10 is shown. The top side is a first polymeric sheet 16 of the bladder 14, also referred to herein as a top sheet. The top side is the exterior surface 17 of the first polymeric sheet 16, which is the foot-receiving surface 17 of the bladder 14 and may be the foot-receiving surface of the sole structure 22 of the article of footwear 12 of FIG. 4. The foot-receiving surface 17 may also be referred to as a foot-facing surface. Optionally, there may be no other layer, cover, or other component of the article of footwear 12 between the bladder 14 and the wearer. This enables a relatively low overall height of the sole structure 22, which may be beneficial for some activities. For example, activities that involve extensive lateral movement and/or for which greater tactile feedback is advantageous may benefit from the use of the strobel 10 disclosed herein. Alternatively, a cover layer (not shown) may overlie the bladder 14.

Figure 2:
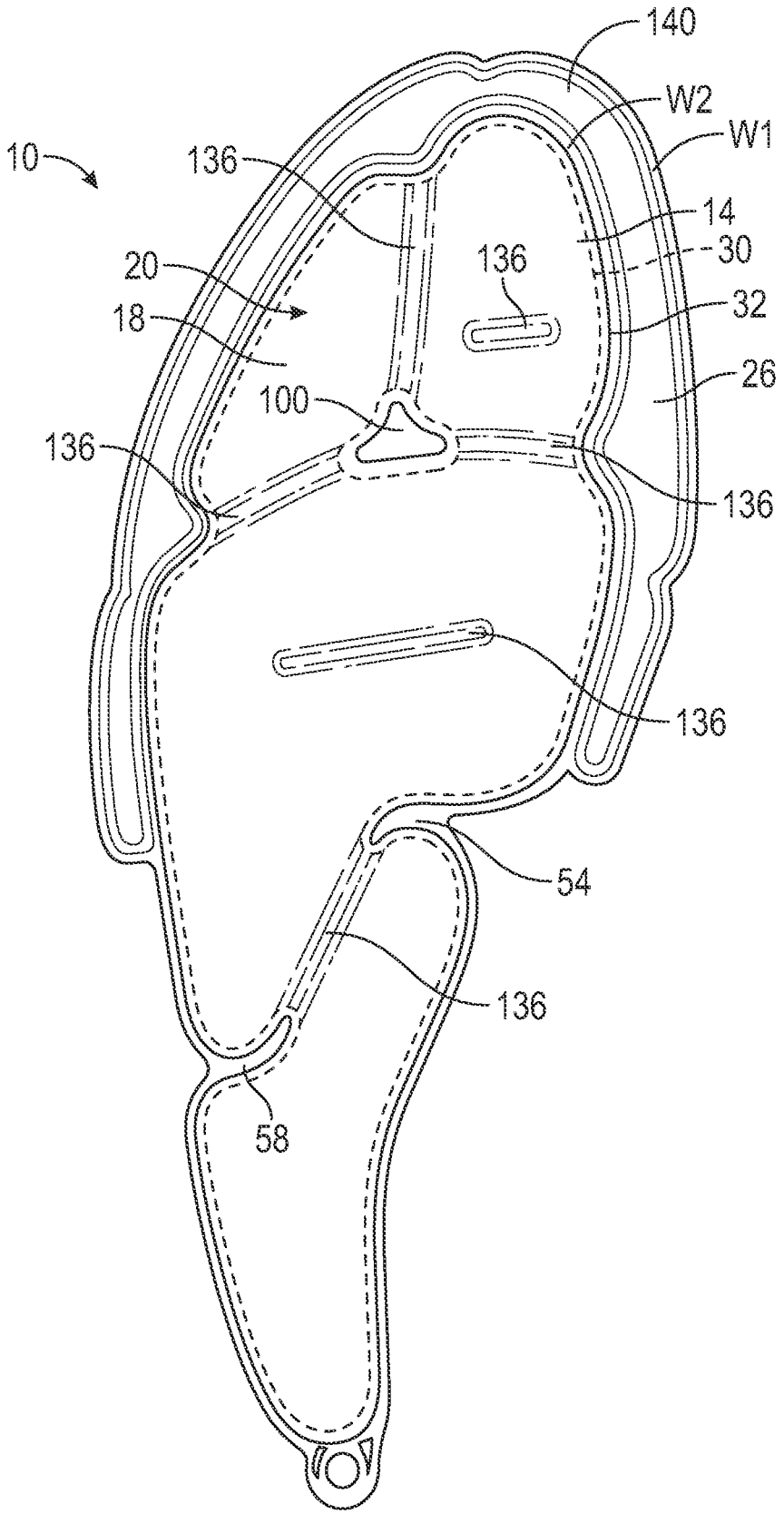
FIG. 2 is a plan view of a bottom side of the strobel of FIG. 1.

FIG. 2 is a plan view of a bottom side (e.g., a second side) of the strobel 10 of FIG. 1. The bottom side is a second polymeric sheet 18 of the bladder 14, also referred to herein as a bottom sheet. The bottom side is the exterior surface 20 of the second polymeric sheet 18, which is the ground-facing surface 20 of the strobel 10 when disposed in the article of footwear 12.

The polymeric bladder 14 defines an interior cavity 24 (best shown in FIGS. 5, 7, and 8) and configured to retain a fluid in the interior cavity 24. More specifically, the first polymeric sheet 16 is secured to the second polymeric sheet 18 at a peripheral flange 26 to enclose the interior cavity 24. Stated differently, when the polymeric sheets 16, 18 are secured together at the peripheral flange 26 and the polymeric bladder 14 is sealed, the first polymeric sheet 16 and the second polymeric sheet 18 retain a fluid in the interior cavity 24. As used herein, a "fluid" filling the interior cavity 24 may be a gas, such as air, nitrogen, another gas, or a combination thereof.

The first and second polymeric sheets 16, 18 can be a variety of polymeric materials that can resiliently retain a fluid such as nitrogen, air, or another gas. Examples of polymeric materials for the first and second polymeric sheets 16, 18 include thermoplastic urethane, polyurethane, polyester, polyester polyurethane, and polyether polyurethane. Moreover, the first and second polymeric sheets 16, 18 can each be formed of layers of different materials including polymeric materials. In one example, each of the first and second polymeric sheets 16, 18 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 16, 18 are disclosed in U.S. Pat. Nos. 4,183,156 and 4,219,945 to Rudy which are incorporated by reference in their entireties. Further suitable materials for the first and second polymeric sheets 16, 18 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder 14, engineering properties such as tensile strength, stretch properties, fatigue characteristics, dynamic modulus, and loss tangent can be considered. For example, the thicknesses of the first and second polymeric sheets 16, 18 used to form the bladder 14 can be selected to provide these characteristics.

The strobel 10 includes a tensile component 30 disposed in the interior cavity 24. The outer extent of the tensile component 30 is shown in hidden lines within the interior cavity 24 in FIGS. 1-4. As is apparent, the tensile component 30 substantially follows the irregular border of the interior cavity 24 which begins just inward of and tracks the irregular shape of the inner extent 32 of the peripheral flange 26 around the outer periphery 34 of the interior cavity 24 and the outer edge 36 of the tensile component 30. In the example shown, the peripheral flange 26 extends generally in an X-Y plane of the bladder 14, where the Z plane is the plane along the height of the bladder 14 from a proximal surface (foot-receiving surface 17) to the distal surface (ground-facing surface 20, indicated in FIG. 5). The peripheral flange 26 extends around the entire bladder 14, and is wider toward the front of the bladder 14, as discussed herein.

Figure 5:
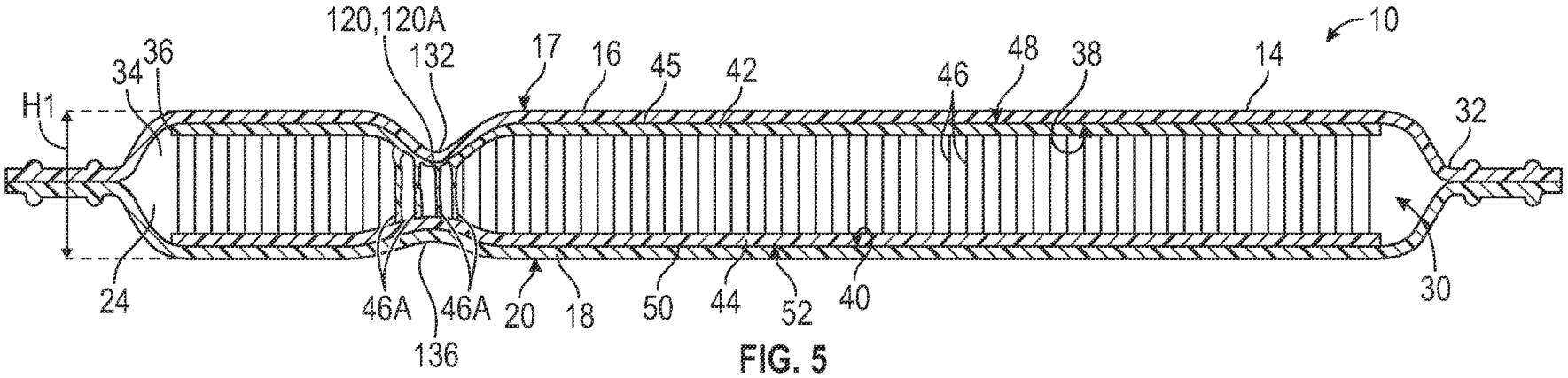
FIG. 5 is a cross-sectional view of the strobel of FIG. 1 taken at lines 5-5 in FIG. 1.

As best shown in FIG. 5, the tensile component 30 is secured to opposing inner surfaces 38, 40 of the polymeric bladder 14. The tensile component 30 includes a first tensile layer 42, a second tensile layer 44, and a plurality of tethers 46 spanning the interior cavity 24 from the first tensile layer 42 to the second tensile layer 44. The tethers 46 connect the first tensile layer 42 to the second tensile layer 44. Only some of the tethers 46 are indicated with reference numbers in FIG. 5. The tethers 46 may also be referred to as fabric tensile members or threads and may be in the form of drop threads that connect the first tensile layer 42 and the second tensile layer 44. The tensile component 30 may be formed as a unitary, one-piece textile element having a spacer-knit textile.

The first tensile layer 42 is bonded to the inner surface 38 of the first polymeric sheet 16, and the second tensile layer 44 is bonded to the inner surface 40 of the second polymeric sheet 18. More specifically, a first surface bond 45 joins the inner surface 38 of the first polymeric sheet 16 to the outer surface 48 of the first tensile layer 42. A second surface bond 50 joins the inner surface 40 of the second polymeric sheet 18 to the outer surface 52 of the second tensile layer 44, opposite the first tensile layer 42. Entire interfacing portions of the surfaces 38, 48 are bonded to one another, and entire interfacing portions of the surfaces 40, 52 are bonded to one another.

Figure 7:
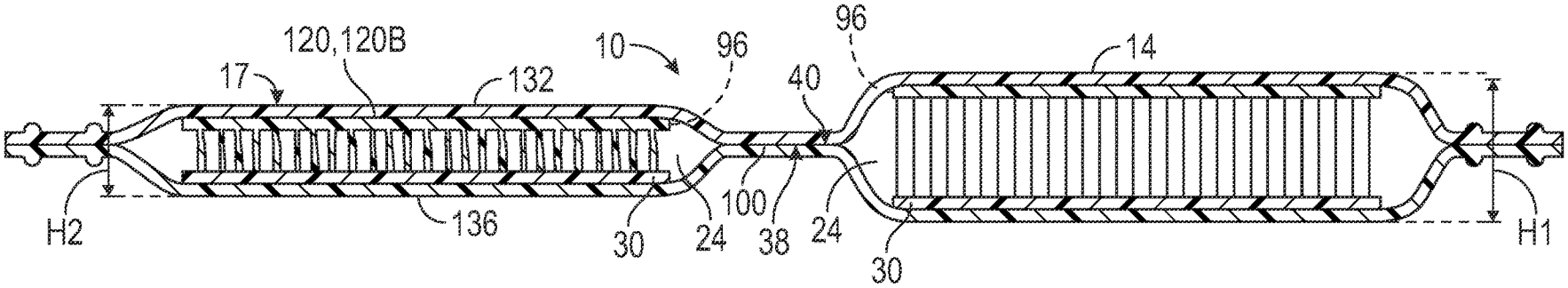
FIG. 7 is a cross-sectional view of the strobel of FIG. 1 taken at lines 7-7 in FIG. 1.

The tethers 46 restrain separation of the first and second polymeric sheets 16, 18 to the maximum separated positions shown in FIG. 5, which depicts the strobel 10 with the interior cavity 24 of the bladder 14 inflated and sealed under a given inflation pressure of gas in the interior cavity 24, so that the strobel 10 is in an inflated state. The outward force on the first and second polymeric sheets 16, 18 due to the pressurized gas in the interior cavity 24 places the tethers 46 in tension, and the tethers 46 prevent the tensile layers 42, 44 and polymeric sheets 16, 18 from further outward movement away from one another. By securing the opposing inner surfaces 38, 40 to one another, the tensile component 30 limits the separation between the opposing inner surfaces 38, 40 due to inflation of the bladder 14. Stated differently, the tensile component 30 limits the height of the inflated bladder 14 to a maximum height H1 from the foot-receiving surface 17 to the ground-facing surface 20 as shown in FIGS. 5 and 7. The maximum height H1 is less than or equal to 5 millimeters. In another example, the maximum height may be less than or equal to 5.5 millimeters, or may be between about 4.5 and 5.5 millimeters. A relatively low height, such as H1, may provide sufficient cushioning and energy return than a higher height without compromising the tactile feedback of the bladder underfoot. Generally, assuming equal pressures in the interior cavity 24, a bladder 14 of greater height will provide less tactile feedback. In an example, the article of footwear 12 may be especially configured as global football (e.g., soccer) footwear to provide cushioning and energy return while still allowing sufficient tactile feedback.

While the tethers 46 limit expansion of the bladder 14 as described, the tethers 46 do not present resistance to compression when the bladder 14 is under a compressive load. When pressure is exerted on the strobel 10 such as due to compressive forces of a dynamic load of a wearer when the article of footwear 12 impacts the ground during running or other movements, the strobel 10 is compressed, and the polymeric sheets 16, 18 move closer together as the tethers 46 collapse (e.g., go slack) in proportion to the load on the first and second polymeric sheets 16, 18 adjacent to the particular tethers 46.

Figure 10:
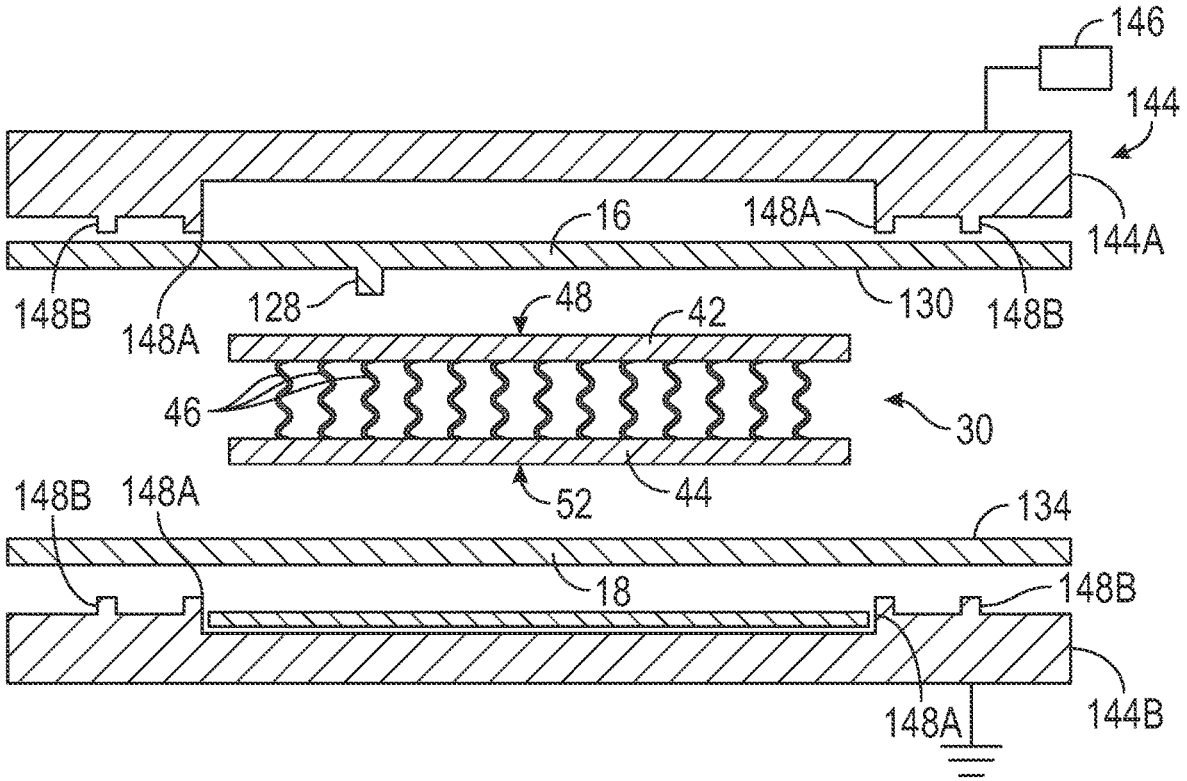
FIG. 10 is a schematic illustration in exploded view of the strobel of FIG. 1 and a tooling assembly.

As shown in FIG. 10, prior to bonding the tensile component 30 to the first and second polymeric sheets 16, 18, the tethers 46 of the tensile component 30 may all be initial lengths, and in some examples all substantially the same length, and the first and second tensile layers 42, 44 connected by the tethers 46 may have generally flat outer surfaces 48, 52, respectively, directly above the tethers 46. In FIG. 10, the tethers 46 are represented in a slackened state as the tensile component 30 is not within a sealed interior cavity between the polymeric sheets 16, 18 and is not subjected to tension as it is when the bladder 14 is in an inflated state and not under a dynamic compressive load.

Figure 8:
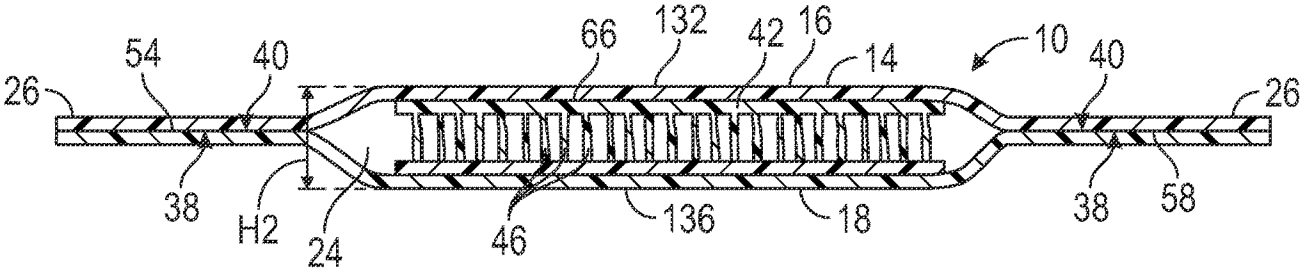
FIG. 8 is a cross-sectional view of the strobel of FIG. 1 taken at lines 8-8 in FIG. 1.

Referring to FIGS. 1 and 8, a first bond 54 secures the opposing inner surfaces 38, 40 of the sheets 16, 18 of the polymeric bladder 14 to one another and extends transversely inward from a medial side 56 of the peripheral flange 26 only partway transversely across the interior cavity 24. A second bond 58 is rearward of the first bond 54, and secures the opposing inner surfaces 38, 40 of the polymeric bladder 14 to one another. The second bond 58 extends transversely inward from a lateral side 60 of the peripheral flange 26 only partway transversely across the interior cavity 24. The outer edge 36 of the tensile component 30 extends transversely inward at and borders a perimeter 62 of the first bond 54 and a perimeter 64 of the second bond 58. Because the tensile component 30 borders and does not extend between the inner surfaces 38, 40 at the first bond 54 and the second bond 58, the bladder 14 is of a lesser height at the first bond 54 and the second bond 58 than at the tensile component 30, creating greater flexibility of the bladder 14 at the first and second bonds 54, 58 than at the tensile component 30. Accordingly, articulation of the bladder 14 tends to occur at the first bond 54 and the second bond 58 under longitudinal or lateral flexing of a foot supported on the bladder 14.

As shown, the first bond 54 and the second bond 58 are both nonlinear. The first bond 54 curves rearward from the medial side 56 of the peripheral flange 26. The second bond 58 curves forward from the lateral side 60 of the peripheral flange 26. By each curving in a direction toward the other, the flexibility of the bladder 14 along a line that connects the two bonds 54, 58 is enhanced. Because the first bond 54 and the second bond 58 extend from opposite sides of the peripheral flange 26 (the medial side 56 and the lateral side 60, respectively), with the second bond 58 rearward of the first bond 54, flexing may tend to occur not only at either or both of the two bonds 54, 58, but along a line between the two bonds 54, 58 which is at an angle to a longitudinal midline of the bladder 14 and extends forward and toward the medial side 56. As further discussed herein, a first partial bond 66 extends along such a line. The first partial bond 66 further increases the flexibility of the bladder 14 as discussed herein.

Figure 3:
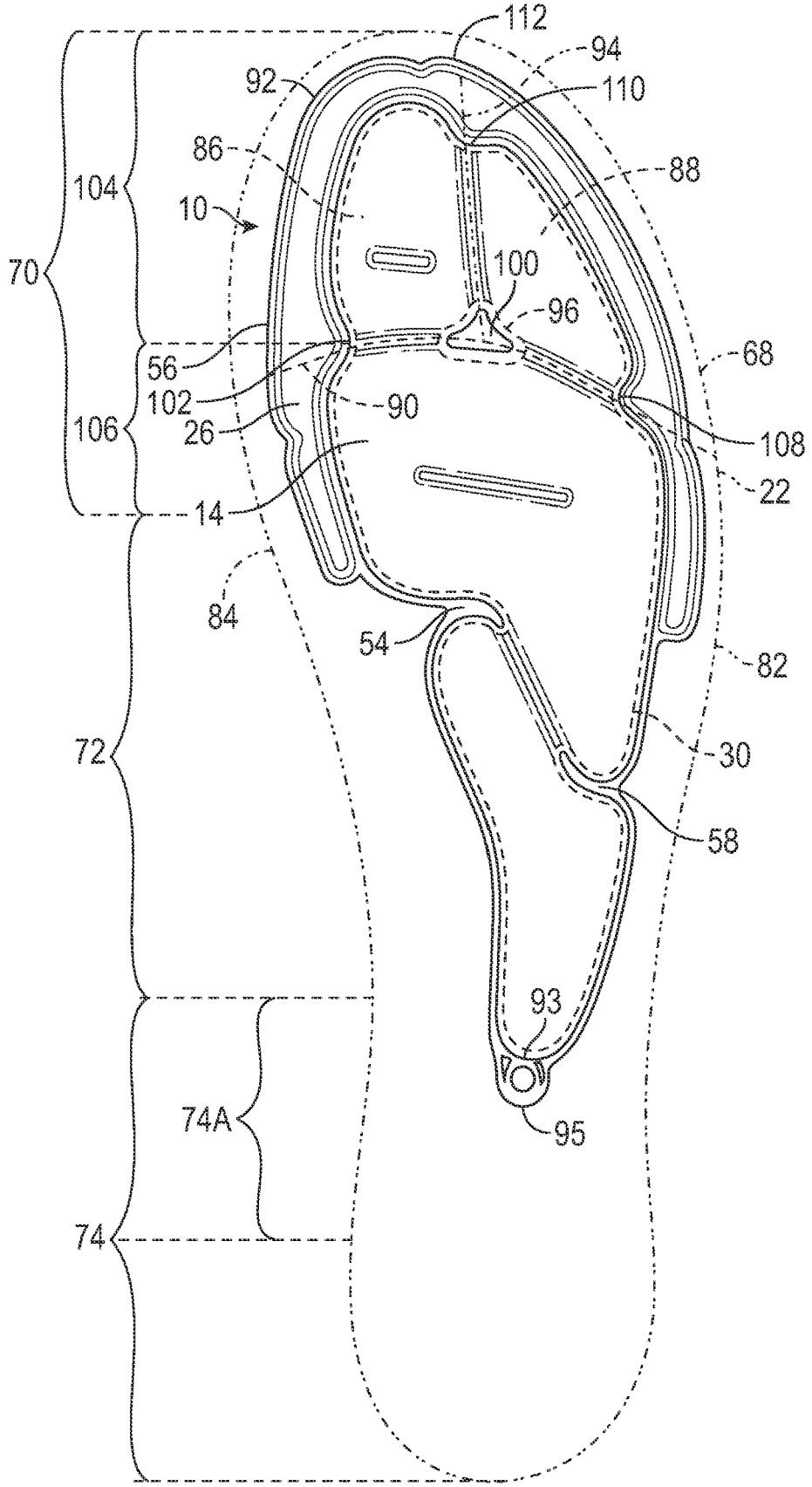
FIG. 3 is a plan view of the top side of the strobel shown relative to a periphery of an article of footwear with the periphery shown in phantom.

FIG. 3 is a plan view of the top side of the strobel 10 shown relative to a periphery 68 of the sole structure 22 of the article of footwear 12 of FIG. 4. The footwear 12 and the sole structure 22 of the footwear 12 have a forefoot region 70, a midfoot region 72, and a heel region 74. FIG. 4 is a side perspective view of the article of footwear 12 having an upper 76 shown in partial cutaway and showing the strobel 10 of FIG. 1 disposed in a foot-receiving cavity 78 with a foot 80 shown in phantom resting on the strobel 10. As indicated in FIGS. 3-4, the footwear 12 may be divided into three general regions: the forefoot region 70, the midfoot region 72, and the heel region 74 which are also the forefoot region, the midfoot region, and the heel region, respectively, of the sole structure 22 (including the strobel 10) and the upper 76. The footwear 12 also includes a lateral side 82 and a medial side 84 (best shown in FIG. 4) opposite to the lateral side 82. The lateral side 82 and the medial side 84 may be used to refer to the respective sides of the upper 76 and the sole structure 22.

The forefoot region 70 generally includes portions of the article of footwear 12 corresponding with the toes and the joints connecting the metatarsals with the phalanges (e.g., the metatarsophalangeal joints). The midfoot region 72 generally includes portions of the article of footwear 12 corresponding with the arch area of the foot, and the heel region 74 corresponds with rear portions of the foot, including the calcaneus bone. The lateral side 82 and the medial side 84 extend through each of forefoot region 70, the midfoot region 72, and the heel region 74 and correspond with opposite sides of the article of footwear 12. The forefoot region 70, the midfoot region 72, the heel region 74, the lateral side 82 and the medial side 84 are not intended to demarcate precise areas of footwear 12, but are instead intended to represent general areas of footwear 12 to aid in the following discussion.

Referring to FIG. 3, the forefoot region 70 of the strobel 10 includes a hallux portion 86 and a second toe portion 88. The hallux portion 86 extends forward from a metatarsophalangeal joint line 90 to an outer periphery 92 of the flange 26, and from the medial side 56 of the flange 26 to a boundary 94 between the hallux portion 86 and the second toe portion 88. The positions of the metatarsophalangeal joint line 90, the hallux portion 86, and the second toe portion 88 may be based on population averages of the corresponding portions of feet of a size corresponding with the size of the article of footwear 12 in which the strobel 10 is disposed.

The tensile component 30 may have an aperture 96 in the forefoot region 70 of the strobel 10. In FIG. 1, the aperture 96 is shown disposed between the hallux portion 86 and the second toe portion 88 and along the metatarsophalangeal joint line 90. As best shown in FIG. 7, the opposing inner surfaces 38, 40 of the first and second polymeric sheets 16, 18 of the bladder 14 are bonded to one another at the aperture 96 at a central bond 100. The fluid-filled interior cavity 24 and the tensile component 30 surround the central bond 100 at the aperture 96. The bladder 14 is only the height of the two polymeric sheets 16, 18 stacked together at the central bond 100, which is less than the height of the surrounding interior cavity 24. There is therefore less resistance to flexing of the bladder 14 at the aperture 96 than at the fluid-filled interior cavity 24, which, due to inflation pressure (if inflated above ambient pressure) and the presence of the tensile component 30, provides greater resistance to flexing and bending than does the central bond 100. An area between the hallux and the second toe is a natural flex area for a foot 80 such as when making a lateral move (a move at least partially in a transverse direction), the central bond 100 enhances the flexibility of the strobel 10. Additionally, because the foot 80 naturally flexes along the metatarsophalangeal joint line 90, if the central bond 100 also falls along the metatarsophalangeal joint line 90, the central bond 100 further increases flexibility of the strobel 10 when disposed in this location.

As is evident in FIGS. 3 and 4, the polymeric bladder 14 extends in the forefoot region 70 and the midfoot region 72 of the footwear 12 and tapers in width (in the transverse direction) in the midfoot region 72 in a rearward direction (e.g., in a direction from the forefoot region 70 toward the heel region 74 of the footwear 12) to a rear extent 93 of the fluid-filled interior cavity 24 that is disposed no further back than a forward half 74A of the heel region 74. In other examples, the rear extent 93 may be in the midfoot region 72. A rear extent 95 of the bladder 14 and of the strobel 10 (e.g., a rear extent of the peripheral flange 26) is also in the forward half 74A of the heel region 74. By limiting the components of the strobel 10 largely to the forefoot and midfoot regions 70, 72 and only a forward half 74A of the heel region 74 (if the bladder 14 extends at all into the heel region 74), the bladder 14 is easier to flex in the longitudinal direction with dorsiflexion of the foot 80. Because the bladder 14 tapers in width as it extends rearward (e.g., the portion of the bladder 14 in the midfoot region 72 is narrower than the portion of the bladder 14 in the forefoot region 70) the cushioning and energy return properties of the bladder 14 are focused in the forefoot region 70 and overall bulk of the strobel 10 is minimized.

Referring again to FIG. 1, in addition to the first bond 54, the second bond 58, and a central bond 100 at the aperture 96 in the tensile component 30, the peripheral flange 26 of the bladder 14 may have inward protrusions 102, 108, and 110 at corresponding notches 107, 109, and 113 in the tensile component 30 to promote flexibility of the bladder 14 at those locations. For example, the peripheral flange 26 may have a medial protrusion 102 protruding transversely inward at the medial side 56 of the peripheral flange 26 to define a boundary between a toe section 104 of the forefoot region 70 of the strobel 10 and a metatarsal section 106 of the forefoot region 70. The boundary between the toe section 104 and the metatarsal section 106 is also defined by the metatarsophalangeal joint line 90 as the medial protrusion 102 falls along the metatarsophalangeal joint line 90. Accordingly, the toe section 104 of the forefoot region 70 is forward of the metatarsophalangeal joint line 90 and the medial protrusion 102, and the metatarsal section 106 is rearward of the metatarsophalangeal joint line 90 and the medial protrusion 102. The outer edge 36 of the tensile component 30 has a notch 107 (see FIG. 1) at which the tensile component 30 extends transversely inward at and borders the medial protrusion 102.

A lateral protrusion 108 of the peripheral flange 26 protrudes transversely inward at the lateral side 60 of the peripheral flange 26 to further define the boundary between the toe section 104 and the metatarsal section 106 as the lateral protrusion 108 falls along the metatarsophalangeal joint line 90. The outer edge 36 of the tensile component 30 has a notch 109 (see FIG. 1) at which the tensile component 30 extends transversely inward at and borders the lateral protrusion 108. Because the peripheral flange 26 is simply the polymeric material of the bladder 14 with no fluid-filled interior cavity 24 between the sheets 16, 18 of the peripheral flange 26, the peripheral flange 26 is thinner (e.g., lower height) than the inflated part of the bladder 14 (e.g., at the interior cavity 24) and so is more easily flexed at the protrusions 102, 108.

Additionally, the peripheral flange 26 has a front protrusion 110 protruding rearward from a front 112 of the peripheral flange 26 as shown in FIG. 3. The front protrusion 110 may fall along the boundary 94 between the hallux portion 86 and the second toe portion 88 of the forefoot region 70. The outer edge 36 of the tensile component 30 has a notch 113 (see FIG. 1) at which the tensile component 30 extends rearward and borders the front protrusion 110. Because the foot 80 naturally flexes at the metatarsophalangeal joint and between the hallux and the second toe, providing the inward protrusions 102, 108, and 110 and notches 107, 109, and 113 in the tensile component 30 at corresponding locations enhances flexibility while still providing cushioning and flexibility under the toes and the metatarsal heads of the foot 80.

In addition to the bonds of the first polymeric sheet 16 to the second polymeric sheet 18 at the first bond 54, the second bond 58, and the central bond 100 (if the aperture 96 is present), the bladder 14 may also have one or more inwardly-protruding partial welds, also referred to as partial bonds, that reduce the thickness (e.g., the height) of the bladder 14 at the partial bond without bonding the inner surfaces 38, 40 to one another. This increases flexibility and promotes flexing of the bladder 14 at the partial weld. For example, referring to FIG. 1, the first polymeric sheet 16 may be joined to the first tensile layer 42 at a first partial bond 66 that protrudes inward from the first polymeric sheet 16 toward the second polymeric sheet 18 only partially across the plurality of tethers 46. Because it extends only partially across the tethers 46 toward the second sheet 18, the fluid-filled interior cavity 24 is present between the sheets 16, 18 at the first partial bond 66. The first partial bond 66 thus creates a narrowing of but not a closure of the interior cavity 24. If a cross-section is taken across the partial bond 66, perpendicular to the cross-section shown in FIG. 8, the height of the bladder 14 is greater on either side of the first partial bond 66 at such a cross-section, similar to the height of the bladder 14 being greater on either side of transverse partial bond 120 as shown in FIG. 5. Because a bladder 14 with a lesser height is easier to flex than a bladder 14 with a greater height, assuming equal fluid pressures, the inflated bladder 14 is easier to flex at the narrowed interior cavity 24 under the first partial bond 66 (e.g., at the reduced height of the bladder 14 at the first partial bond 66). The first partial bond 66 extends across the first polymeric sheet 16 from the first bond 54 to the second bond 58, thereby creating a location at which bending (e.g., flexing) of the bladder 14 will most easily occur. The reduced thickness of the bladder 14 is uninterrupted from the first bond 54, along the first partial bond 66, to the second bond 58.

Similarly, the first polymeric sheet 16 may be joined to the first tensile layer 42 at a transverse partial bond 120 that protrudes inward from the first polymeric sheet 16 toward the second polymeric sheet 18 only partially across the plurality of tethers 46. The transverse partial bond 120 is shown in FIG. 1 and in cross-section at both FIGS. 5 and 7, and extends from the lateral protrusion 108 to the medial protrusion 102, interrupted only by the central bond 100 in examples having such. The transverse partial bond 120 extends along the metatarsophalangeal joint line 90 to track the metatarsophalangeal joints of an overlying foot. If the aperture 96 and central bond 100 are present, the transverse partial bond 120 may extend to the central bond 100. For example, a lateral portion 120A of the transverse partial bond 120 may extend from the lateral protrusion 108 to the central bond 100, and a medial portion 120B of the transverse partial bond 120 may extend from the medial protrusion 102 to the central bond 100.

Figure 9:
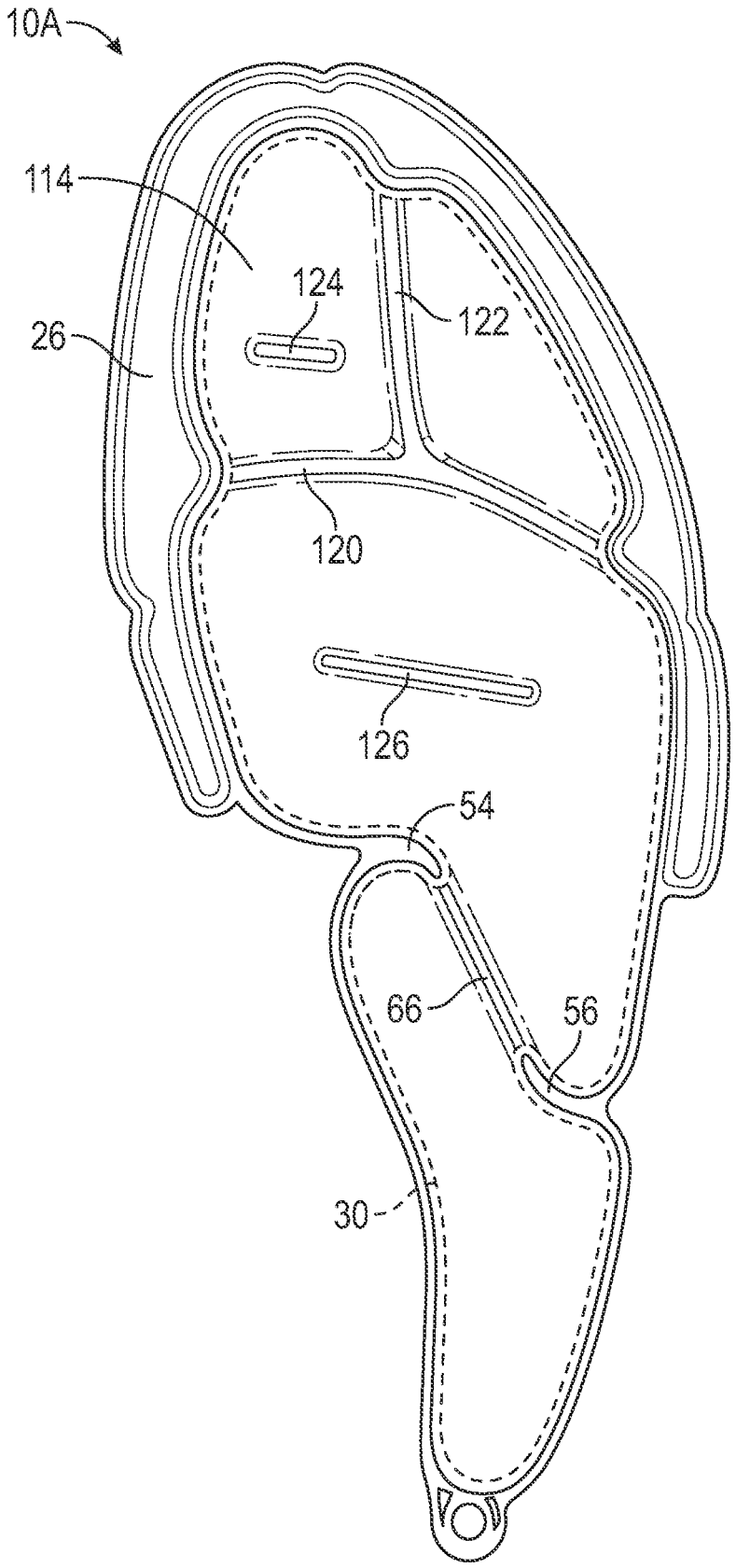
FIG. 9 is a plan view of a top side of an alternative example of a strobel for an article of footwear.

The bladder 14 may also have a front partial bond 122 at which the first polymeric sheet 16 is joined to the first tensile layer 42. The front partial bond 122 protrudes inward from the first polymeric sheet 16 toward the second polymeric sheet 18 only partially across the plurality of tethers 46. The front partial bond 122 extends from the front protrusion 110 rearward toward the transverse partial bond 120. In examples in which the aperture 96 and central bond 100 are present, the front partial bond 122 extends to the central bond 100. Accordingly, both the transverse partial bond 120 and the front partial bond 122 extend from the respective inward protrusions 102, 108, and 110 of the peripheral flange 26 to the central bond 100. FIG. 9 shows an example of a strobel 10A with a bladder 114 alike in all aspects to bladder 14 except that the aperture 96 and the central bond 100 are not present. In the bladder 114, the front partial bond 122 extends to the transverse partial bond 120 as the transverse partial bond 120 is not interrupted by any central bond 100.

Additional partial bonds that protrude inward from the first polymeric sheet 16 toward the second polymeric sheet 18 only partially across the plurality of tethers 46 may include a toe joint partial bond 124 and/or a middle partial bond 126. The toe joint partial bond 124 extends forward of and is non-intersecting with the transverse partial bond 120 and non-intersecting with the front partial bond 122. The toe joint partial bond 124 is configured to align with and underlie an overlying joint of a hallux of the foot 80 forward of the metatarsophalangeal joint of the overlying foot 80.

The middle partial bond 126 extends rearward of the transverse partial bond 120 and forward of the first partial bond 66, and is non-intersecting with the transverse partial bond 120 and the first partial bond 66. The middle partial bond 126 is disposed between the medial side 56 of the peripheral flange 26 and the lateral side 60 of the peripheral flange 26 without extending completely to either side 56, 60. The middle partial bond 126 has a medial end 126A terminating transversely inward of and spaced apart from the medial side 56 of the peripheral flange 26, and a lateral end 126B terminating transversely inward of and spaced apart from the lateral side 60 of the peripheral flange 26. Accordingly, the interior cavity 24 completely surrounds the middle partial bond 126 such that the middle partial bond 126 does not fluidly isolate a portion of the interior cavity 24 forward of the middle partial bond 126 from a portion of the interior cavity 24 rearward of the middle partial bond 126.

Although the tethers 46 may be originally of the same length and the outer surfaces 48, 52 of the first and second tensile layers 42, 44 and the exterior surfaces 17, 20 of the first and second polymeric sheets 16, 18, respectively, may originally be generally flat directly above the tethers (e.g., not contoured) prior to forming the strobel 10, the partial bonds 66, 120, 122 124, and 126 that join the first polymeric sheet 16 to the first tensile layer 42 protrude inward from the first polymeric sheet 16 toward the second polymeric sheet 18 directly into a region of the interior cavity 24 occupied by some of the tethers 46. Each partial bond 66, 120, 122 124, and 126 protrudes farther toward the second polymeric sheet 18 than the first surface bond 45. The partial bonds 66, 120, 122 124, and 126 protrude inward from the first polymeric sheet 16 only partially across the plurality of tethers 46 toward the second polymeric sheet 18, and the polymeric bladder 14 is narrowed at the partial bonds 66, 120, 122 124, and 126. For example, the partial bonds 66, 120, 122 124, and 126 (as well as the bond at the peripheral flange 26, the first and second bonds 54, 58, and the central bond 100) may be formed by a welding process, such as radio frequency or ultrasonic welding using tooling that results in thermal bonds in the polymeric bladder 14. Each partial bond 66, 120, 122 124, and 126 results from a respective protrusion 128 of a mold component such as mold insert 130 of FIG. 10. The mold insert 130 has a pattern of protrusions in a spacing that result in the partial bonds 66, 120, 122 124, and 126. For purposes of discussion, only one protrusion 128 is shown at the cross-section of FIG. 10. The protrusion 128 contacts the first polymeric sheet 16 during manufacturing of the bladder 14.

The partial bonds 66, 120, 122 124, and 126 result in depressed grooves 132 at the foot-receiving surface 17 of the first polymeric sheet 16. One depressed groove 132 is shown in FIG. 5 at the lateral portion 120A of the partial bond 120. FIG. 7 is taken along the length of the medial portion 120B of the partial bond 120. Accordingly, the portion of FIG. 7 to the left of the central bond 100 is along the length of a depressed groove 132, as indicated by the lesser height H2 of the left portion in comparison to the height H1 of the portion to the right of the central bond 100. FIG. 8 is likewise taken along a length of the partial bond 66 and therefore along a length of the depressed groove 132, as indicated by the lower height H2. In the example shown, the partial bonds 66, 120, 122 124, and 126 are only at the first polymeric sheet 16 protruding inward toward the second polymeric sheet 18, as a mold insert 134 placed adjacent the second sheet 18 in FIG. 10 has no protrusions aligned with the tensile component 30. Optionally, the mold insert 134 could also have protrusions to result in partial bonds extending inward toward the first sheet 16 from the second sheet 18.

Each partial bond 66, 120, 122 124, and 126 partially traverses the plurality of tethers 46 as shown with respect to partial bond 120 in FIG. 5. Stated differently, the partial bonds 66, 120, 122 124, and 126 are directly outward of different ones of the tethers 46 and protrude inward on those tethers 46. The tethers 46 may be arranged in rows, with each row extending transversely between the tensile layers 42, 44, or in any other pattern in which the tethers 46 extend between the tensile layers 42, 44. Various different ones of the tethers 46 are aligned with the partial bonds 66, 120, 122 124, and 126.

Tethers 46 that are aligned with the partial bonds 66, 120, 122 124, and 126 are deformed by heat, by compression of the overlaying material of the first tensile layer 42, and/or by the overlaying material of the first tensile layer 42 coating the tethers 46 such that the tethers 46 are shorter, thicker, or both shorter and thicker at the partial bonds 66, 120, 122 124, and 126 than elsewhere (e.g., than away from the partial bonds 66, 120, 122, 124, and 126). Such deformed tethers are indicated with reference numeral 46A in FIG. 5 and may be referred to as modified tethers 46A.

When the interior cavity 24 is inflated, the modified tethers 46A result in the depressed grooves 132 in the foot-receiving surface 17 of the first polymeric sheet 16 as indicated in FIG. 5. When an inflation pressure of the gas in the interior cavity 24 is sufficient to tension the plurality of tethers 46, the inwardly-protruding partial bonds 66, 120, 122 124, and 126 define grooves 132 at the foot-receiving surface 17 of the first polymeric sheet 16. At each depressed groove 132, the strobel 10 is divided into what may be referred to as a first article portion on one side of the depressed groove 132 and a second article portion on the other side of the depressed groove 132. The first article portion is articulated relative to the second article portion along the depressed groove 132. Stated differently, the foot-receiving surface 17 of the first polymeric sheet 16 is non-planar at the depressed groove 132.

The tension of the modified tethers 46A also causes recesses 136 in the ground-facing surface 20 of the second polymeric sheet 18 that are aligned with the depressed grooves 132 (see FIGS. 5, 7, and 8). The second polymeric sheet 18 is recessed inward toward a corresponding depressed groove 132 and inwardly-protruding partial bond 66, 120, 122 124, or 126 at each recess 136 when the interior cavity 24 is inflated.

The physical deformation of the first polymeric sheet 16 and the first tensile layer 42 combined with the tension of the modified tethers 46A will cause the depressed grooves 132 to be deeper than the recesses 136, which result only from the tension of the shortened modified tethers 46A. Accordingly, the bladder 14 may have an articulated shape (such as when inflated, not assembled with or constrained by other components, and not under loading), causing the bladder 14 to be slightly concave at the foot-receiving surface 17 and slightly convex at the ground-facing surface 20. The strobel 10 will thus be biased to an articulated shape, as the depressed grooves 132 and recesses 136 together encourage articulation of the strobel 10 to occur at the depressed grooves 132, as the overall thickness of the strobel 10 is reduced at the depressed grooves 132, decreasing bending stiffness of the strobel 10 at the depressed grooves 132. Due to the depressed grooves 132 and the further narrowing of the bladder 14 by the corresponding recesses 136, as discussed above, the inwardly-protruding partial bonds 66, 120, 122, 124, and 126 act as flexion axes of the bladder 14 thereby increasing flexibility of the sole structure 22 when the strobel 10 is included in the sole structure 22 of the article of footwear 12 as in FIG. 4.

Each partial bond 66, 120, 122, 124, and 126 is spaced apart from the second polymeric sheet 18 such that the interior cavity 24 is narrowed but not closed at the partial bond 66, 120, 122, 124, and 126, and the gas in the interior cavity 24 can still fluidly communicate across the partial bond 66, 120, 122, 124, and 126. The modified tethers 46A are narrow in diameter and allow gas to flow around and between the tethers 46A. This allows the gas to be displaced from the interior cavity 24 at one side of the tethers 46A to the interior cavity 24 at the other side of the tethers 46A when compressive forces are applied to the strobel 10, such as during impact of the article of footwear 12 with the ground. For example, as a foot rolls forward from heel to toe during a foot strike, the gas may be displaced from rearward in the bladder 14 to a portion more forward in the bladder 14. Supportive cushioning provided by the fluid in the interior cavity 24 can thus be continuously provided in areas most needed during use of the strobel 10.

Factors that may influence the partial bonds 66, 120, 122, 124, and 126 and the extent of their protrusion toward the second polymeric sheet 18 can be controlled to provide a desired narrowing. Such factors may include the depth of the protrusions 128 that create the partial bonds 66, 120, 122, 124, and 126, the temperature of the mold insert 130 or other mold components, the temperature of the components of the strobel 10 (e.g., the polymeric sheets 16, 18 and the tensile component 30), vacuum and/or inflation pressures in the mold cavity during manufacturing, the weld power or weld frequency if radio frequency welding is used, and other factors.

Other aspects of the bladder 14 may enable its easy integration within the article of footwear 12. For example, as shown in FIG. 1, the peripheral flange 26 is wider forward of the first bond 54 than rearward of the first bond 54 at both the medial side 56 and the lateral side 60. The wider peripheral flange 26 in this area enables it to be easily stitched or otherwise secured to the footwear upper 76. Additionally, the peripheral flange 26 defines a groove 140 extending lengthwise along the peripheral flange 26 from the medial side 56 to the lateral side 60 and forward of the first bond 54. The groove 140 may serve as a visible path for a needle to follow when stitching the upper 76 to the peripheral flange 26 of the bladder 14, for example.

Figure 6:
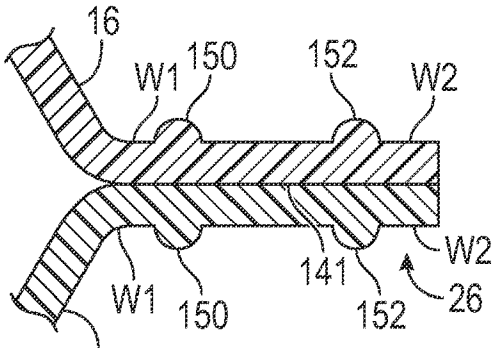
FIG. 6 is a fragmentary view of a portion of the strobel of FIG. 5 showing a peripheral flange of the strobel.

With reference to FIG. 6, the peripheral flange 26 has a first weld W1 and a second weld W2 spaced apart from the first weld W1. The first weld W1 and the second weld W2 cause the first and second polymeric sheets 16, 18 to bond to one another at an interface 141 at the welds W1, W2. The welds W1 and W2 may be formed by using the mold assembly 144 of FIG. 10 that includes mold portions 144A, 144B. The mold portions 144A, 144B are closed together on the polymeric sheets 16, 18, with the tensile component 30 between the polymeric sheets 16, 18. The polymeric sheets 16, 18 and tensile component 30 are then welded by radio frequency welding (also referred to as high frequency or dielectric welding) or are secured by another manner of thermal or adhesive bonding, as a power source 146 supplies energy creating an alternating electric field that heats the polymeric sheets 16, 18 where the mold portions 144A, 144B or mold inserts 130, 134 are applied to the polymeric sheets 16, 18. In an example with welds W1, W2 on both sides of the peripheral flange 26 as in FIG. 6, both mold inserts 130, 134 include ridges 148A, 148B that cause the respective welds W1, W2. In other examples, the welds W1 W2 and groove 140 may be only on the top side or only on the bottom side of the flange 26. Because the polymeric sheets 16, 18 may be transparent, the groove 140 may be visible on the opposite side when only provided on one side.

The first weld W1 and the second weld W2 extend lengthwise along the peripheral flange 26. As best shown in FIG. 1, the first weld W1 and the second weld W2 extend continuously along only the wider portion of the peripheral flange 26 (from the location 151 on the medial side 56, around the front of the bladder 14, to the location 153 on the lateral side 60. The groove 140 extends lengthwise along the peripheral flange 26 between the first weld W1 and the second weld W2. The first weld W1 is inward of the groove 140 and the second weld W2 is outward of the groove 140 where inward is toward the center of the bladder 14 and outward is away from the center of the bladder 14.

Referring to FIGS. 1 and 6, heating and pressure of the mold assembly 144 at the welds W1 and W2 may displace some of the material of the polymeric sheets 16, 18 so that the peripheral flange 26 may include a first ridge 150 protruding from the peripheral flange 26 between the first weld W1 and the groove 140, and a second ridge 152 protruding from the peripheral flange 26 between the second weld W2 and the groove 140. The ridges 150, 152 help to define the sides of the groove 140.

The strobel 10 may be disposed in the sole structure 22 for a right foot article of footwear 12 as in FIG. 4, or may be flipped over for disposing in a sole structure for a left foot article of footwear. In either case, one of the two grooves 140 will be in the same position relative to the upper 76 in both instances to serve as a guide for stitching or other securement modes. In examples having a groove 140 on only one of the sides (in the top sheet 16 or the bottom sheet 18) of the peripheral flange 26, because the polymeric sheets 18, 16 may be transparent, the groove 140 may be visible at the distal side even in examples in which a groove 140 is provided only on the proximal side and vice versa.

The following Clauses provide example configurations of a strobel for an article of footwear disclosed herein.

Clause 1. A strobel for an article of footwear, the strobel comprising: a polymeric bladder defining an interior cavity and configured to retain a fluid in the interior cavity, the polymeric bladder having a peripheral flange extending around at least a portion of a perimeter of the interior cavity; a first bond securing opposing inner surfaces of the polymeric bladder to one another and extending transversely inward from a medial side of the peripheral flange only partway transversely across the interior cavity; a second bond rearward of the first bond, securing the opposing inner surfaces of the polymeric bladder to one another, and extending transversely inward from a lateral side of the peripheral flange only partway transversely across the interior cavity; and a tensile component disposed in the interior cavity and secured to the opposing inner surfaces of the polymeric bladder; wherein an outer edge of the tensile component extends transversely inward at and borders a perimeter of the first bond and a perimeter of the second bond.

Clause 2. The strobel of clause 1, wherein the polymeric bladder extends in a forefoot region and a midfoot region of the strobel and tapers in width in the midfoot region to a rear extent of the tensile component.

Clause 3. The strobel of any of the preceding clauses, wherein: the tensile component has an aperture in a forefoot region of the strobel disposed between a hallux portion and a second toe portion of the forefoot region; and the opposing inner surfaces are bonded to one another at the aperture.

Clause 4. The strobel of any of the preceding clauses, wherein the first bond and the second bond are nonlinear.

Clause 5. The strobel of any of the preceding clauses, wherein the first bond curves rearward from the medial side of the peripheral flange.

Clause 6. The strobel of any of the preceding clauses, wherein the second bond curves forward from the lateral side of the peripheral flange.

Clause 7. The strobel of any of the preceding clauses, wherein: the polymeric bladder includes a first polymeric sheet and a second polymeric sheet secured to one another at and forming the peripheral flange, the first bond, and the second bond; the opposing inner surfaces including a first inner surface of the first polymeric sheet and a second inner surface of the second polymeric sheet; and the tensile component includes a first tensile layer secured to the first inner surface, a second tensile layer secured to the second inner surface, and a plurality of tethers spanning the interior cavity from the first tensile layer to the second tensile layer and connecting the first tensile layer to the second tensile layer.

Clause 8. The strobel of any of the preceding clauses, wherein; the first polymeric sheet is joined to the first tensile layer at a first partial bond that protrudes inward from the first polymeric sheet toward the second polymeric sheet only partially across the plurality of tethers; and the first partial bond extends across the first polymeric sheet from the first bond to the second bond.

Clause 9. The strobel of any of the preceding clauses, wherein: the peripheral flange has a medial protrusion protruding transversely inward at the medial side of the peripheral flange to define a boundary between a toe section of a forefoot region of the strobel and a metatarsal section of the forefoot region of the strobel; and the outer edge of the tensile component extends transversely inward at and borders the medial protrusion of the peripheral flange.

Clause 10. The strobel of any of the preceding clauses, wherein: the peripheral flange has a lateral protrusion protruding transversely inward at the lateral side of the peripheral flange to define a boundary between a toe section of a forefoot region of the strobel and a metatarsal section of the forefoot region of the strobel; and the outer edge of the tensile component extends transversely inward at and borders the lateral protrusion of the peripheral flange.

Clause 11. The strobel of any of the preceding clauses, wherein: the peripheral flange has a medial protrusion protruding transversely inward at the medial side of the peripheral flange between the toe section and the metatarsal section of the forefoot region of the strobel; and the outer edge of the tensile component extends transversely inward at and borders the medial protrusion of the peripheral flange.

Clause 12. The strobel of any of the preceding clauses, wherein: the polymeric bladder includes a first polymeric sheet and a second polymeric sheet secured to one another at and forming the peripheral flange, the first bond, and the second bond; the opposing inner surfaces including a first inner surface of the first polymeric sheet and a second inner surface of the second polymeric sheet; the tensile component includes a first tensile layer secured to the first inner surface, a second tensile layer secured to the second inner surface, and a plurality of tethers spanning the interior cavity from the first tensile layer to the second tensile layer and connecting the first tensile layer to the second tensile layer; the first polymeric sheet is joined to the first tensile layer at a transverse partial bond that protrudes inward from the first polymeric sheet toward the second polymeric sheet only partially across the plurality of tethers; and the transverse partial bond extends from the lateral protrusion to the medial protrusion.

Clause 13. The strobel of any of the preceding clauses, wherein: the peripheral flange has a front protrusion protruding rearward from a front of the peripheral flange; the outer edge of the tensile component extends rearward at and borders the front protrusion of the peripheral flange; the first polymeric sheet is joined to the first tensile layer at a front partial bond that protrudes inward from the first polymeric sheet toward the second polymeric sheet only partially across the plurality of tethers; and the front partial bond extends from the front protrusion rearward toward the transverse partial bond.

Clause 14. The strobel of any of the preceding clauses, wherein the tensile component has an aperture in the forefoot region of the strobel disposed between a hallux portion and a second toe portion of the toe section; the opposing inner surfaces are bonded to one another at a central bond at the aperture of the tensile component; and the transverse partial bond and the front partial bond extend to the central bond.

Clause 15. The strobel of any of the preceding clauses, wherein: the first polymeric sheet is joined to the first tensile layer at a toe joint partial bond that protrudes inward from the first polymeric sheet toward the second polymeric sheet only partially across the plurality of tethers; and the toe joint partial bond extends forward of the transverse partial bond and is non-intersecting with the transverse partial bond and non-intersecting with the front partial bond.

Clause 16. The strobel of any of the preceding clauses, wherein: the first polymeric sheet is joined to the first tensile layer at a first partial bond that protrudes inward from the first polymeric sheet toward the second polymeric sheet only partially across the plurality of tethers; the first partial bond extends across the first polymeric sheet from the first bond to the second bond; the first polymeric sheet is joined to the first tensile layer at a middle partial bond that protrudes inward from the first polymeric sheet toward the second polymeric sheet only partially across the plurality of tethers; and the middle partial bond extends rearward of the transverse partial bond and forward of the first partial bond, and is non-intersecting with the transverse partial bond and the first partial bond.

Clause 17. The strobel of any of the preceding clauses, wherein the peripheral flange is wider forward of the first bond than rearward of the first bond at both the medial side and the lateral side.

Clause 18. The strobel of any of the preceding clauses, wherein the peripheral flange defines a groove extending lengthwise along the peripheral flange from the medial side to the lateral side and forward of the first bond.

Clause 19. The strobel of any of the preceding clauses, wherein a maximum height of the strobel is less than or equal to 5 millimeters.

Clause 20. A strobel for an article of footwear, in particular according to any of the proceeding clauses, the strobel comprising: a polymeric bladder defining an interior cavity and configured to retain a fluid in the interior cavity, the polymeric bladder having a peripheral flange extending around at least a portion of a perimeter of the interior cavity; and a tensile component disposed in the interior cavity and secured to opposing inner surfaces of the polymeric bladder; wherein the tensile component has an aperture in a forefoot region of the strobel between a hallux portion and a second toe portion of the forefoot region; and wherein the opposing inner surfaces are bonded to one another at the aperture.

Clause 21. The strobel of any of the preceding clauses, wherein the peripheral flange has a medial protrusion protruding transversely inward at a medial side of the peripheral flange in the forefoot region and a lateral protrusion protruding transversely inward at a lateral side of the peripheral flange in the forefoot region; and wherein an outer edge of the tensile component extends transversely inward at and borders the medial protrusion and the lateral protrusion.

Clause 22. The strobel of any of the preceding clauses, wherein: the peripheral flange has a front protrusion protruding rearward from a front of the peripheral flange; and the outer edge of the tensile component extends rearward at and borders the front protrusion of the peripheral flange.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A strobel for an article of footwear, the strobel comprising:

a polymeric bladder defining an interior cavity and configured to retain a fluid in the interior cavity, the polymeric bladder having a peripheral flange extending around at least a portion of a perimeter of the interior cavity;

a first bond securing opposing inner surfaces of the polymeric bladder to one another and extending transversely inward from a medial side of the peripheral flange only partway transversely across the interior cavity to an end of the first bond;

a second bond separate and distinct from the first bond, the second bond rearward of the first bond, securing the opposing inner surfaces of the polymeric bladder to one another, and extending transversely inward from a lateral side of the peripheral flange only partway transversely across the interior cavity to an end of the second bond; and a unitary tensile component disposed in the interior cavity and secured to the opposing inner surfaces of the polymeric bladder; wherein an outer edge of the unitary tensile component extends transversely inward at and borders a perimeter of the first bond both forward and rearward of the first bond and continuing around the end of the first bond, and borders a perimeter of the second bond both forward and rearward of the second bond and continuing around the end of the second bond, the unitary tensile component disposed between the end of the first bond and the end of the second bond.

2. The strobel of claim 1, wherein the polymeric bladder extends in a forefoot region and a midfoot region of the strobel and tapers in width in the midfoot region to a rear extent of the unitary tensile component.

3. The strobel of claim 1, wherein:

the unitary tensile component has an aperture in a forefoot region of the strobel disposed between a hallux portion and a second toe portion of the forefoot region; and the opposing inner surfaces are bonded to one another at the aperture.

4. The strobel of claim 1, wherein the first bond curves rearward from the medial side of the peripheral flange.

5. The strobel of claim 1, wherein the second bond curves forward from the lateral side of the peripheral flange.

6. The strobel of claim 1, wherein:

the polymeric bladder includes a first polymeric sheet and a second polymeric sheet secured to one another at and forming the peripheral flange, the first bond, and the second bond; the opposing inner surfaces including a first inner surface of the first polymeric sheet and a second inner surface of the second polymeric sheet; and the unitary tensile component includes a first tensile layer secured to the first inner surface, a second tensile layer secured to the second inner surface, and a plurality of tethers spanning the interior cavity from the first tensile layer to the second tensile layer and connecting the first tensile layer to the second tensile layer.

7. The strobel of claim 6, wherein;

the first polymeric sheet is joined to the first tensile layer at a first partial bond that protrudes inward from the first polymeric sheet toward the second polymeric sheet only partially across the plurality of tethers; and the first partial bond extends across the first polymeric sheet from the first bond to the second bond.

8. The strobel of claim 1, wherein:

the peripheral flange has a medial protrusion protruding transversely inward at the medial side of the peripheral flange to define a boundary between a toe section of a forefoot region of the strobel and a metatarsal section of the forefoot region of the strobel; and the outer edge of the unitary tensile component extends transversely inward at and borders the medial protrusion of the peripheral flange.

9. The strobel of claim 1, wherein:

the peripheral flange has a lateral protrusion protruding transversely inward at the lateral side of the peripheral flange to define a boundary between a toe section of a forefoot region of the strobel and a metatarsal section of the forefoot region of the strobel; and the outer edge of the unitary tensile component extends transversely inward at and borders the lateral protrusion of the peripheral flange.

10. The strobel of claim 9, wherein:

the peripheral flange has a medial protrusion protruding transversely inward at the medial side of the peripheral flange between the toe section and the metatarsal section of the forefoot region of the strobel; and the outer edge of the unitary tensile component extends transversely inward at and borders the medial protrusion of the peripheral flange.

11. The strobel of claim 10, wherein:

the polymeric bladder includes a first polymeric sheet and a second polymeric sheet secured to one another at and forming the peripheral flange, the first bond, and the second bond; the opposing inner surfaces including a first inner surface of the first polymeric sheet and a second inner surface of the second polymeric sheet;

the unitary tensile component includes a first tensile layer secured to the first inner surface, a second tensile layer secured to the second inner surface, and a plurality of tethers spanning the interior cavity from the first tensile layer to the second tensile layer and connecting the first tensile layer to the second tensile layer;

the first polymeric sheet is joined to the first tensile layer at a transverse partial bond that protrudes inward from the first polymeric sheet toward the second polymeric sheet only partially across the plurality of tethers; and the transverse partial bond extends from the lateral protrusion to the medial protrusion.

12. The strobel of claim 1, wherein the peripheral flange is wider forward of the first bond than rearward of the first bond at both the medial side and the lateral side.

13. The strobel of claim 12, wherein the peripheral flange defines a groove extending lengthwise along the peripheral flange from the medial side to the lateral side and forward of the first bond.

14. A strobel for an article of footwear, the strobel comprising:

a polymeric bladder defining an interior cavity and configured to retain a fluid in the interior cavity, the polymeric bladder having a peripheral flange extending around at least a portion of a perimeter of the interior cavity;

a first bond securing opposing inner surfaces of the polymeric bladder to one another and extending transversely inward from a medial side of the peripheral flange only partway transversely across the interior cavity;

a second bond rearward of the first bond, securing the opposing inner surfaces of the polymeric bladder to one another, and extending transversely inward from a lateral side of the peripheral flange only partway transversely across the interior cavity; and a tensile component disposed in the interior cavity and secured to the opposing inner surfaces of the polymeric bladder; wherein an outer edge of the tensile component extends transversely inward at and borders a perimeter of the first bond and a perimeter of the second bond;

wherein:

the peripheral flange has a lateral protrusion protruding transversely inward at the lateral side of the peripheral flange to define a boundary between a toe section of a forefoot region of the strobel and a metatarsal section of the forefoot region of the strobel;

the outer edge of the tensile component extends transversely inward at and borders the lateral protrusion of the peripheral flange;

the peripheral flange has a front protrusion protruding rearward from a front of the peripheral flange;

the outer edge of the tensile component extends rearward at and borders the front protrusion of the peripheral flange;

the peripheral flange has a medial protrusion protruding transversely inward at the medial side of the peripheral flange between the toe section and the metatarsal section of the forefoot region of the strobel;

the outer edge of the tensile component extends transversely inward at and borders the medial protrusion of the peripheral flange;

the polymeric bladder includes a first polymeric sheet and a second polymeric sheet secured to one another at and forming the peripheral flange, the first bond, and the second bond;

the opposing inner surfaces including a first inner surface of the first polymeric sheet and a second inner surface of the second polymeric sheet;

the tensile component includes a first tensile layer secured to the first inner surface, a second tensile layer secured to the second inner surface, and a plurality of tethers spanning the interior cavity from the first tensile layer to the second tensile layer and connecting the first tensile layer to the second tensile layer;

the first polymeric sheet is joined to the first tensile layer at a transverse partial bond that protrudes inward from the first polymeric sheet toward the second polymeric sheet only partially across the plurality of tethers;

the transverse partial bond extends from the lateral protrusion to the medial protrusion;

the first polymeric sheet is joined to the first tensile layer at a front partial bond that protrudes inward from the first polymeric sheet toward the second polymeric sheet only partially across the plurality of tethers; and the front partial bond extends from the front protrusion rearward toward the transverse partial bond.

15. The strobel of claim 14, wherein:

the tensile component has an aperture in the forefoot region of the strobel disposed between a hallux portion and a second toe portion of the toe section;

the opposing inner surfaces are bonded to one another at a central bond at the aperture of the tensile component; and the transverse partial bond and the front partial bond extend to the central bond.

16. The strobel of claim 14, wherein:

the first polymeric sheet is joined to the first tensile layer at a toe joint partial bond that protrudes inward from the first polymeric sheet toward the second polymeric sheet only partially across the plurality of tethers; and the toe joint partial bond extends forward of the transverse partial bond and is non-intersecting with the transverse partial bond and non-intersecting with the front partial bond.

17. The strobel of claim 14, wherein:

the first polymeric sheet is joined to the first tensile layer at a first partial bond that protrudes inward from the first polymeric sheet toward the second polymeric sheet only partially across the plurality of tethers;

the first partial bond extends across the first polymeric sheet from the first bond to the second bond;

the first polymeric sheet is joined to the first tensile layer at a middle partial bond that protrudes inward from the first polymeric sheet toward the second polymeric sheet only partially across the plurality of tethers; and the middle partial bond extends rearward of the transverse partial bond and forward of the first partial bond, and is non-intersecting with the transverse partial bond and the first partial bond.

18. A strobel for an article of footwear, the strobel comprising:

a polymeric bladder defining an interior cavity and configured to retain a fluid in the interior cavity, the polymeric bladder having a peripheral flange extending around at least a portion of a perimeter of the interior cavity; and a tensile component disposed in the interior cavity and secured to opposing inner surfaces of the polymeric bladder; wherein the tensile component has an aperture in a forefoot region of the strobel between a hallux portion and a second toe portion of the forefoot region;

wherein the aperture is entirely surrounded by the tensile component; and wherein the opposing inner surfaces are bonded to one another at the aperture.

19. The strobel of claim 18, wherein the peripheral flange has a medial protrusion protruding transversely inward at a medial side of the peripheral flange in the forefoot region and a lateral protrusion protruding transversely inward at a lateral side of the peripheral flange in the forefoot region; and wherein an outer edge of the tensile component extends transversely inward at and borders the medial protrusion and the lateral protrusion.

20. The strobel of claim 19, wherein:

the peripheral flange has a front protrusion protruding rearward from a front of the peripheral flange; and the outer edge of the tensile component extends rearward at and borders the front protrusion of the peripheral flange.

* * * * *